US005295273A

United States Patent [19]

Unger et al.

[11] Patent Number: 5,295,273

[45] Date of Patent: Mar. 22, 1994

[54] PRESSURIZED FLUSH TOILET COUPLING

[75] Inventors: Jason D. Unger, Plymouth; John M. Bloemer, Sheboygan, both of Wis.

[73] Assignee: Kohler Company, Kohler, Wis.

[21] Appl. No.: 823,902

[22] Filed: Jan. 22, 1992

[51] Int. Cl.[5] ..... E03D 11/00

[52] U.S. Cl. ..... 4/417

[58] Field of Search ..... 4/354, 355, 356, 357, 4/358, 359, 360, 361, 362, 417, 418

[56] References Cited

U.S. PATENT DOCUMENTS

| | | | |
|---|---|---|---|
| 957,028 | 3/1910 | Bassett et al. | 4/334 |
| 1,277,165 | 8/1918 | Winters | 4/418 X |
| 1,907,193 | 5/1933 | Weaver | 4/398 |
| 3,026,535 | 3/1962 | Langdon | 4/358 |
| 3,052,892 | 9/1962 | Witham | 4/26 |
| 3,154,794 | 11/1964 | Antunez, Jr. | 4/57 |
| 4,034,423 | 7/1977 | Milnes | 4/41 |
| 4,233,698 | 11/1980 | Martin | 4/354 |
| 4,703,956 | 11/1987 | Keech | 285/156 |
| 4,757,560 | 7/1988 | Grimstad | 4/417 |
| 5,005,226 | 4/1991 | Basile et al. | 4/354 |
| 5,046,201 | 9/1991 | Steinhardt | 4/354 |

FOREIGN PATENT DOCUMENTS

| | | | |
|---|---|---|---|
| 3435646 | 4/1986 | Fed. Rep. of Germany | 4/417 |

*Primary Examiner*—William A. Cuchlinski, Jr.
*Assistant Examiner*—W. Morris Worth
*Attorney, Agent, or Firm*—Quarles & Brady

[57] ABSTRACT

A coupling connects a pressurized flush water vessel held in a toilet tank to a toilet bowl. The coupling has a passageway which provides direct fluid communication between the vessel and the bowl and a chamber for accumulating drainage, which may be exhausted into the toilet tank from inlet devices for the pressure vessel. A swinging door type one way valve substantially seals against leakage from the passageway to the chamber but allows drainage accumulated in the chamber to flow through a port to the passageway. The inlet to the chamber is above the port and at or below the bottom of the toilet tank and the port and the chamber inlet open above the spill level of the toilet. The inlet of the coupling is offset from the outlet and a cradle elevates the pressure vessel above the toilet tank bottom and captures heads of fasteners which secure the toilet tank to the toilet bowl.

17 Claims, 4 Drawing Sheets

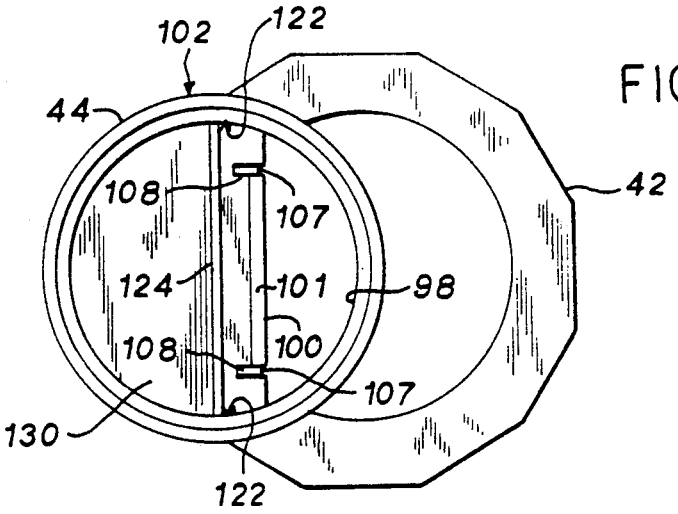
FIG. 8
FIG. 9
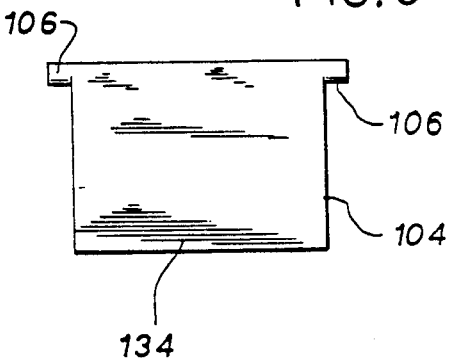
FIG. 10
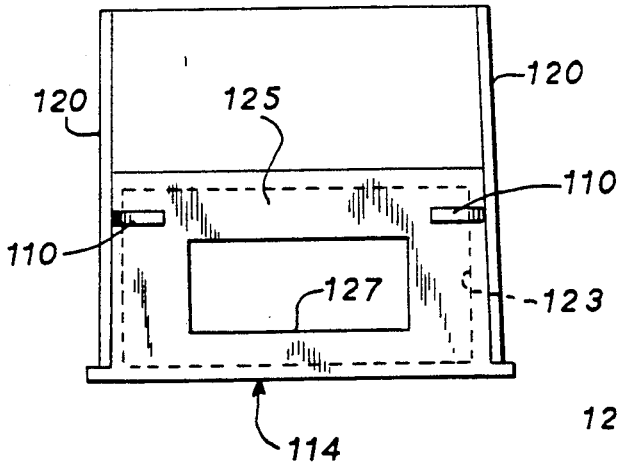
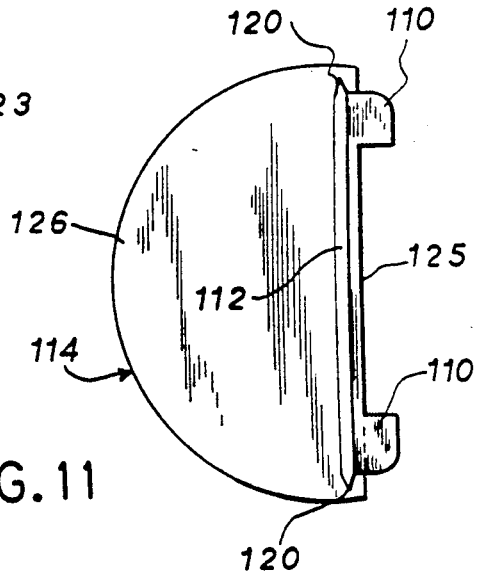
FIG. 11

PRESSURIZED FLUSH TOILET COUPLING

FIELD OF THE INVENTION

This invention relates to pressurized flush toilets, and in particular to a coupling for connecting a pressurized flush water supply and a toilet bowl.

BACKGROUND OF THE INVENTION

Pressurized flush toilets are well known and are of a variety of types. In one type, a valve is installed between a pressurized inlet water line and the inlet to the toilet bowl. Actuation of the valve effects a timed flush of the toilet bowl with water at the inlet line pressure. In another type, a volume of flush water is stored in a pressurized vessel, which may reside in the usual vitreous or plastic toilet tank of the toilet as in U.S. Pat. No. 5,046,201. In this type, the pressurized contents of the vessel are expelled to the toilet bowl to effect a flush when the outlet of the pressurized vessel is opened.

Particularly in pressurized flush toilets having a pressurized reservoir vessel, the reservoir vessel may have a number of components such as a backflow preventer, a pressure regulator and/or an aspirator which connect the vessel to a pressurized water line. These inlet devices require venting because occasionally they may emit water outside of the pressurized supply. For example, if the pressure limit of the pressure regulator is exceeded, the pressure regulator relief diverts the excess pressure from the reservoir vessel to exhaust through the vent line to atmospheric pressure Exhausting water may also occur by the normal operation of the backflow preventer and aspirator.

In toilets having a pressurized reservoir vessel within an integral tank of the toilet, as in U.S. Pat. No. 5,046,201, the vent lines of the inlet devices can be communicated with the toilet bowl directly.

However, it is desirable to be able to use a pressurized flush reservoir vessel in two piece toilets, in which the toilet tank is one piece and the toilet bowl is another, separate piece. It is also desirable to be able to easily retrofit a pressurized flush vessel to a toilet, one piece or two piece, in which no special provision is made in the toilet casting process for venting the inlet devices to the toilet bowl. Such toilets present a problem for venting the inlet devices, since there is no direct access from inside the toilet tank to the toilet bowl for venting the inlet devices. In such toilets, drainage has been provided by a check valve in the connection between the pressurized flush vessel and the toilet bowl which opened directly into the toilet tank, but such drainage has resulted in pools of standing water in the toilet tank, which is undesirable.

SUMMARY OF THE INVENTION

The invention provides a coupling for providing communication between a pressurized flush water supply and a toilet bowl which provides for improved drainage from the toilet tank to the toilet bowl, so that the inlet devices may acceptably be vented to inside of the toilet tank. The coupling has a passageway for providing communication between an outlet of the pressurized flush water supply and an inlet of the toilet bowl. A chamber in the coupling has an inlet for collecting drainage from outside of the chamber and a valve provides fluid communication from the chamber to the passageway such that liquid drainage accumulated in the chamber can pass through the valve to the passageway. However, the valve automatically seals against substantial fluid communication from the passageway to the chamber during the flush.

Preferably, the chamber inlet opens into a water storage toilet tank for collecting liquid from the toilet tank, which may for example have been expelled outside of the pressurized supply into the toilet tank from inlet devices for a pressure vessel of the pressurized supply. In an especially useful form, the chamber inlet is positioned at or below the bottom of the toilet tank so that substantially all standing water in the tank is drained to the chamber inlet.

In another useful aspect, the chamber inlet is located above the valve such that any leakage past the valve from the passageway to the chamber will collect in the chamber rather than exit the chamber through the chamber inlet. Thus, leakage from the passageway will not flow into the toilet tank. This also helps keep the toilet tank substantially dry.

In another aspect, the chamber inlet and the valve are positioned to have openings that are at least partially above the spill level of the toilet bowl. This is preferred so that in the case of a sub-atmospheric pressure in the supply, the chamber inlet and valve will provide a vacuum breaker so that possibly contaminated water is not sucked back from the toilet bowl into the supply.

In another aspect, the coupling has an inlet which is laterally offset from an outlet of the coupling. This feature is desirable to allow making a toilet bowl which is shorter in length by approximately the amount of the offset.

In another preferred aspect, the pressurized flush water supply is supported within the toilet tank by a cradle. The cradle captures heads of fasteners which secure the toilet tank to the toilet bowl, which provides for facile assembly and disassembly of two piece toilets.

It is therefore a principal object of the invention to provide an improved coupling for connecting a pressurized flush water supply to a toilet bowl.

It is another principal object to provide such a coupling for draining a toilet tank.

It is another object of the invention to provide such a coupling which is particularly adapted for a two piece toilet.

It is another object of the invention to provide such a coupling which substantially drains all standing water from a toilet tank.

It is another object of the invention to provide such a coupling which contains reverse leakage past a one way valve during a flush from entering the toilet tank and subsequently drains such leakage to the toilet bowl.

It is another object of the invention to provide such a coupling which also provides a vacuum breaker against possibly contaminated water being sucked into the pressurized water supply.

It is another object of the invention to provide such a coupling which allows making the toilet bowl shorter.

It is another object of the invention to provide such a coupling in which a cradle supports the pressurized flush water supply above the bottom of the toilet tank.

It is another object of the invention to provide such a coupling and cradle which facilitate assembly and disassembly of a pressurized flush toilet.

It is another object of the invention to provide such a coupling which provides for a controlled flush of the toilet.

These and other objects and advantages of the invention will be apparent from the drawings and the following description.

BRIEF DESCRIPTION OF THE DRAWINGS

FIG. 8 is a bottom plan view of a housing for the coupling;

FIG. 9 is a front plan view of a door for the coupling;

FIG. 10 is a front plan view of an insert for the coupling; and

FIG. 11 is a top plan view of the insert.

DETAILED DESCRIPTION OF THE PREFERRED EMBODIMENTS

Figure 1:
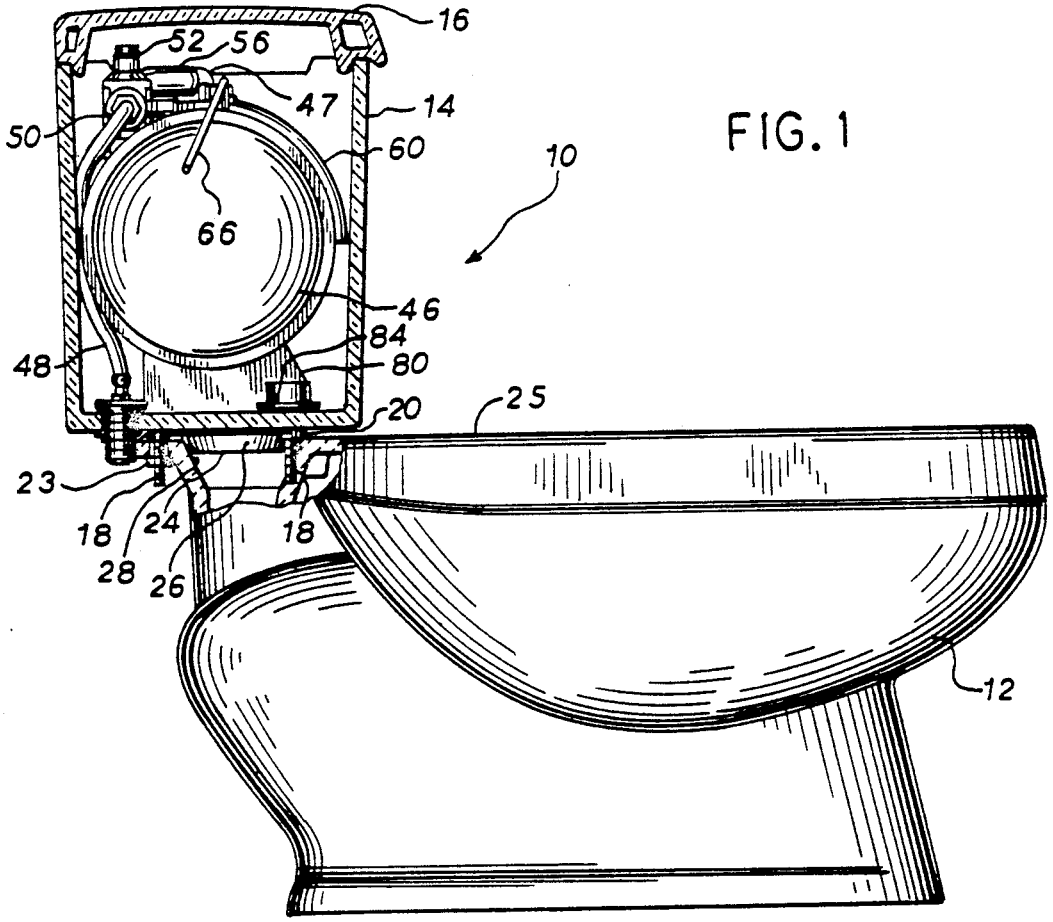
FIG. 1 is a side elevational view of a toilet incorporating the invention with a portion of the toilet tank and a portion of the tank/bowl interface region broken away.

Referring to FIG. 1, a toilet 10 incorporating the invention has a toilet bowl 12, a toilet tank 14 and preferably a toilet tank cover 16. In the preferred embodiment, the toilet tank 14 is in one piece and the toilet bowl 12 is in another, separate piece. As is well known, the toilet bowl 12, toilet tank 14 and toilet tank cover 16 can be made of a vitreous or plastic material.

Figure 3:
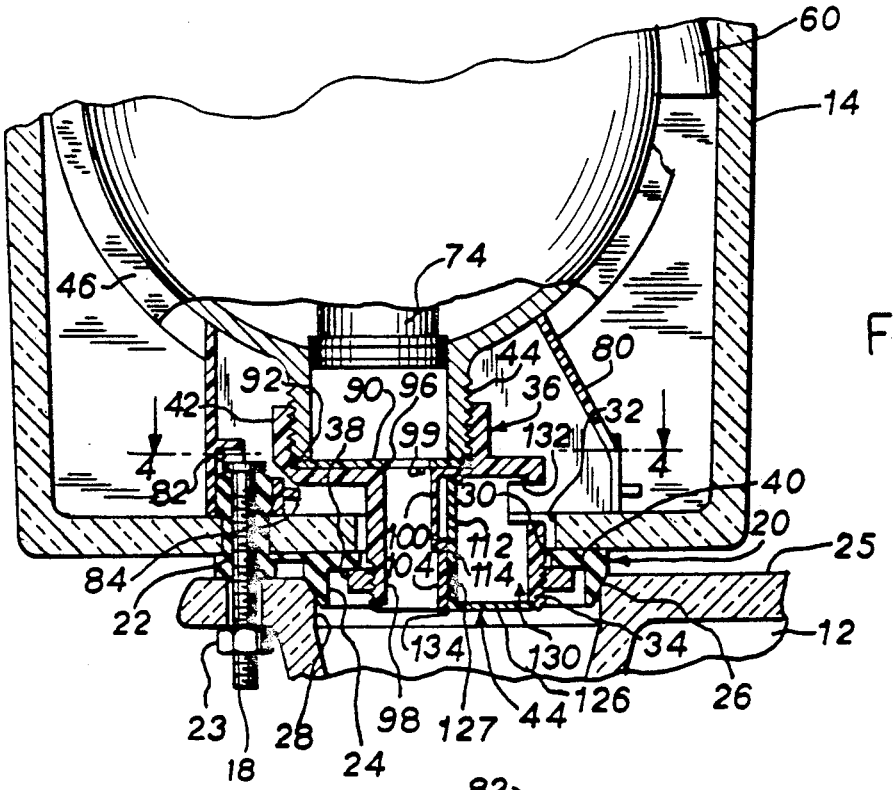
FIG. 3 is a detailed cross-sectional view of a portion of the toilet of FIG. 1.
Figure 4:
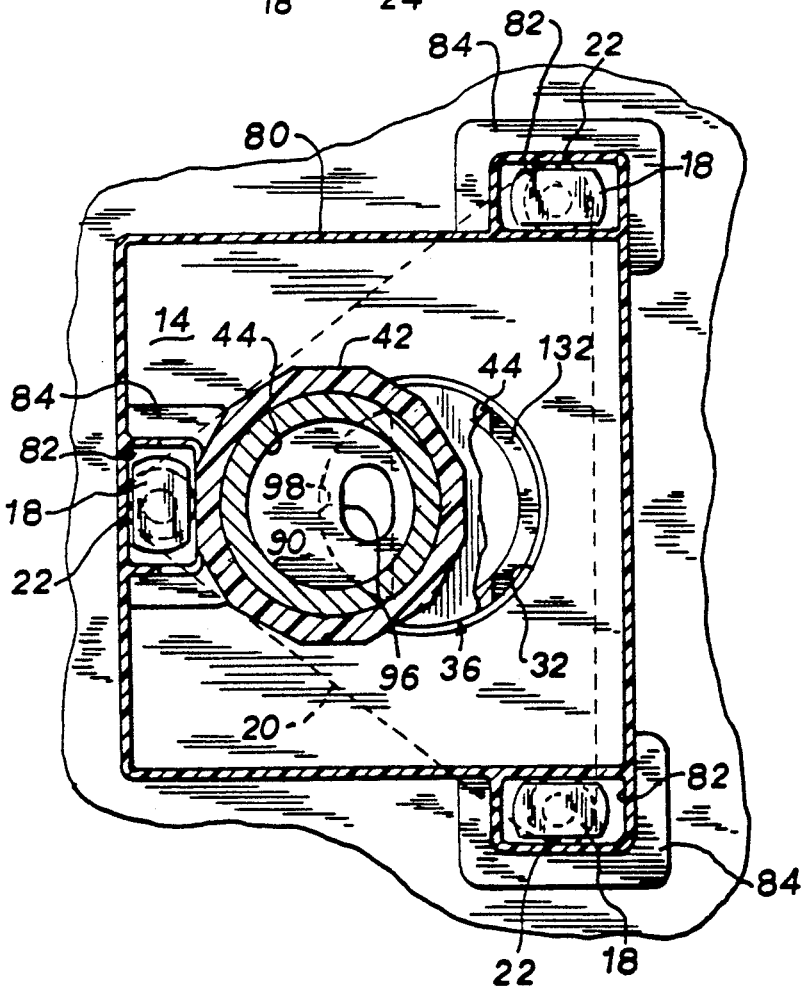
FIG. 4 is a cross-sectional view taken along the plane of the line 4—4 of FIG. 3.

Referring particularly to FIGS. 3 and 4, the toilet tank 14 is sealed and secured to the toilet bowl 12 by three T-bolts 18 and an elastomeric gasket 20, preferably such a gasket as is described in U.S. Pat. No. 4,757,560, issued Jul. 19, 1988, entitled "Toilet Tank Gasket". The T-bolts 18 have a rounded head in which two opposite sides are straight and the shanks of the T-bolts 18 extend through ferrules 22 of the gasket 20 and through a top deck 25 of the toilet bowl 12. Nuts 23 on the underside of the deck of the toilet bowl 12 tighten the T-bolts 18, which compresses the gasket 20 to provide a fluid tight seal with the holes in the bottom of the tank 14 through which the T-bolts 18 and ferrules 22 of the gasket 20 extend.

The gasket 20 has a generally circular bowl inlet seal portion 24 having an external frusto-conical surface 26 which seals against a similarly shaped interior frusto-conical surface of the bowl inlet 28. Tightening the bolts 18 draws the inlet seal portion 24 against the bowl inlet 28 and into fluid tight engagement with the bottom of the tank 14 and the bowl inlet 28, in a conventional manner.

The inlet seal portion 24 has a hole 30 and the tank 14 has a hole 32 through which an outlet portion 34 of a coupling 36 of the present invention extends. The lower end of the outlet portion 34 has external threads onto which a nut 38 is screwed up tight against flange 40 of inlet seal portion 24. At the upper end of the coupling 36, an inlet portion 42 of the coupling 36 has internal threads which receive in threaded engagement the outlet 44 of pressurized flush reservoir vessel 46.

The pressurized flush reservoir vessel 46 may be substantially the same as that described in U.S. Pat. No. 5,046,201, the disclosure of which is hereby incorporated by reference, although any pressurized flush supply may be used to practice the invention. Briefly, the vessel 46 has an inlet 47 connected to a pressurized water line 48 via a backflow preventer 50, a pressure regulator 52, an aspirator 54 and a connecting line 56. The backflow preventer 50, pressure regulator 52 and aspirator 54, hereinafter collectively referred to as inlet devices, admit a mixture of water and air to the interior of the vessel 46 until the desired pressure (controlled by the pressure regulator 52) within the vessel 46 is attained, and prevent reverse flow of water from the vessel 46 to the potable water supply within line 48.

Figure 2:
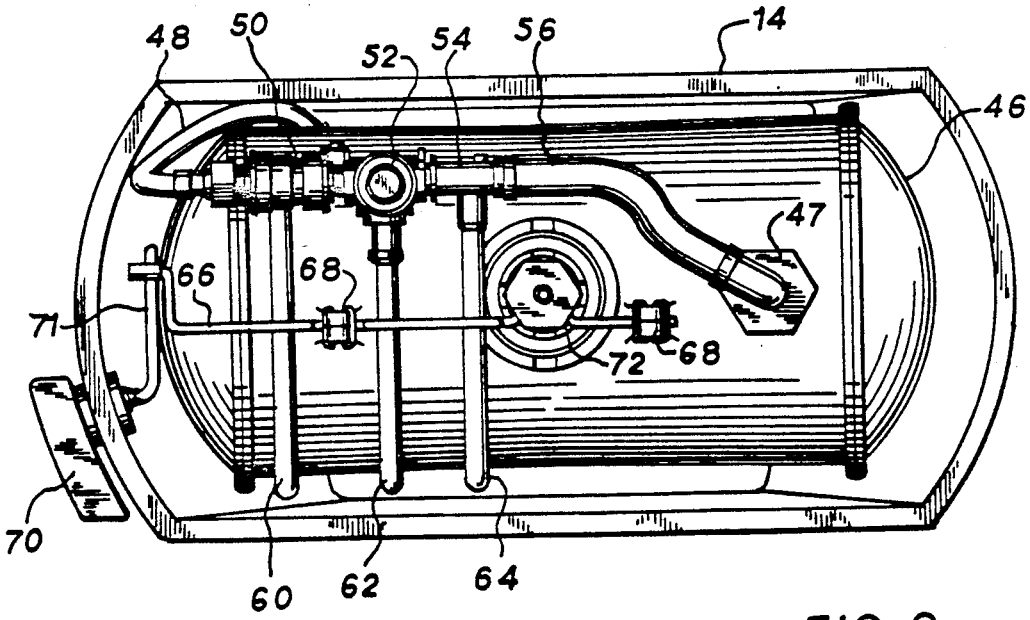
FIG. 2 is a top plan view of the toilet tank shown in FIG. 1 with the toilet tank cover removed.

Each of the inlet devices 50, 52 and 54 has a respective vent line 60, 62 and 64 (see FIGS. 1–3) which opens outside of the vessel 46 but inside of the toilet tank 14. Any water exhausted by the inlet devices 50, 52 and 54 exits the respective device via the respective vent line 60, 62 or 64 and is expelled to the interior of the toilet tank 14, outside of the pressurized reservoir vessel 46.

A rotary lever arm 66 is journaled in bearings 68 on the pressure vessel 46 so that when the arm 66 is rotated by lifting arm 71 by operating handle 70, nut 72 is lifted by the arm 66. Lifting nut 72 opens outlet valve 74 (see FIG. 3) of the vessel 46, which causes the contents of the vessel 46 to be expelled through vessel outlet 44.

The pressure vessel 46 is supported within the toilet tank 14 by a cradle 80, which is preferably made of a suitable rigid molded plastic material, such as 30% glass filled polypropylene. In addition to supporting the vessel 46 above the bottom of the tank 14, the cradle 80 has three recesses 82, one to receive each of the heads of the T-bolts 18 and the associated ferrule 22 of the gasket 20. As best shown in FIG. 4, the recesses 82 enclose the heads of the T-bolts 18 to prevent rotation of the T-bolts 18 relative to the cradle 80. For additional strength, the walls of the recesses 82 are preferably provided with strengthening ribs 84. Thereby, the T-bolts 18 are prevented from turning when the nuts 23 are tightened or removed from the T-bolts 18.

Referring more specifically to the coupling 36, the inlet portion 42 is generally cylindrical as is the outlet portion 34. The coupling 36 of the preferred embodiment is preferably made of a rigid molded plastic material, such as ABS Cycolac DH, which is commercially available from General Electric Plastics, Pittsfield, Massachusetts. The inlet portion 42 is offset rearwardly from the outlet portion 34 and provided with flats (see FIGS. 4 and 8) so that it may be engaged by a wrench for tightening on the vessel outlet 44. Offsetting the inlet portion 42 rearwardly from the outlet portion 34 by approximately 1 inch allows making the toilet bowl 12 approximately 1 inch shorter, for a savings of material, reduced weight and easier handling of the toilet bowl 12 in process.

Between the bottom of the vessel outlet 44 and coupling inlet 42 resides a restrictor plate 90 and an O-ring 92. The O-ring 92 seats against a flange 94 of the restrictor plate and the bottom of the vessel outlet 44 to provide a fluid tight seal between the pressure vessel 46 and the coupling 36. The restrictor plate 90 has an orifice 96 to provide a controlled size opening into passageway 98 which is formed in the outlet portion 34 of the coupling 36. Protrusion 99 formed on the surface of the restrictor plate 90 fits within passageway 98 to prevent restrictor plate 90 from rotating relative to the coupling 36 so that the orifice 96 remains in alignment with the passageway 98. Passageway 98 is preferably straight from inlet to outlet so as not to provide any appreciable pressure drop through it.

Figure 5:
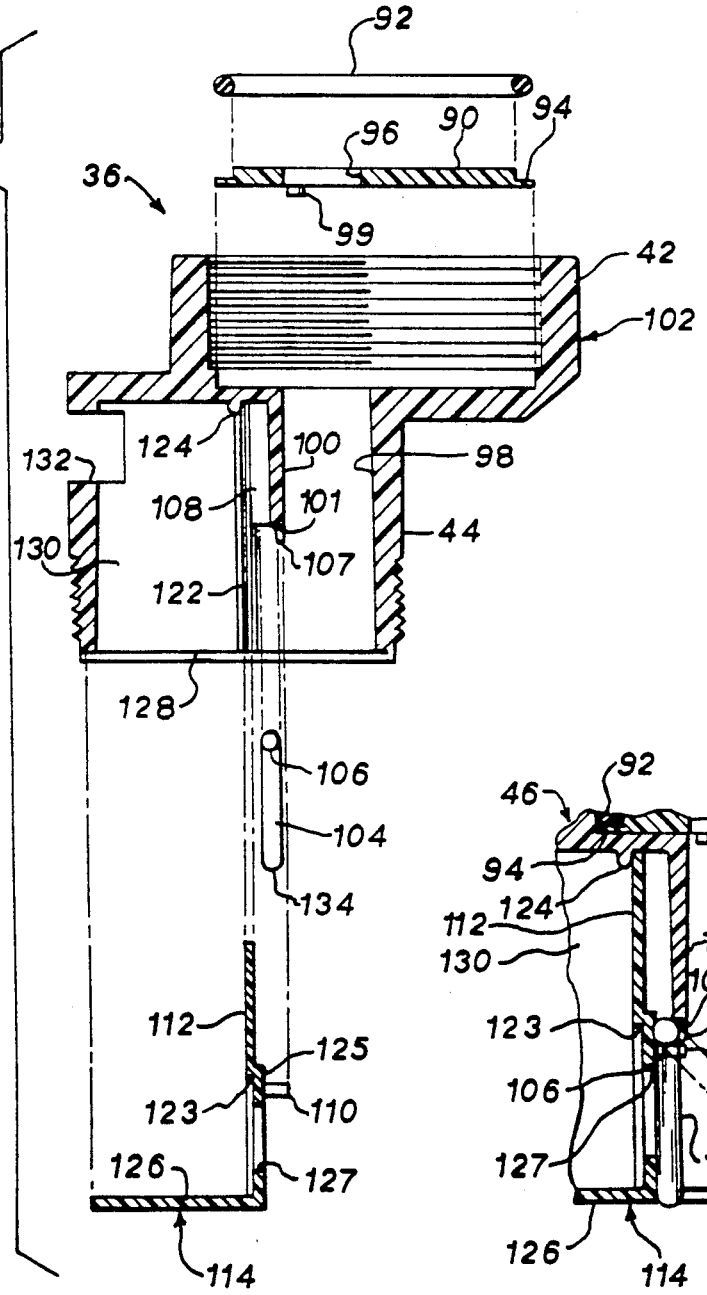
FIG. 5 is an exploded cross-sectional view of a coupling for the toilet of FIG. 1.
Figure 6:
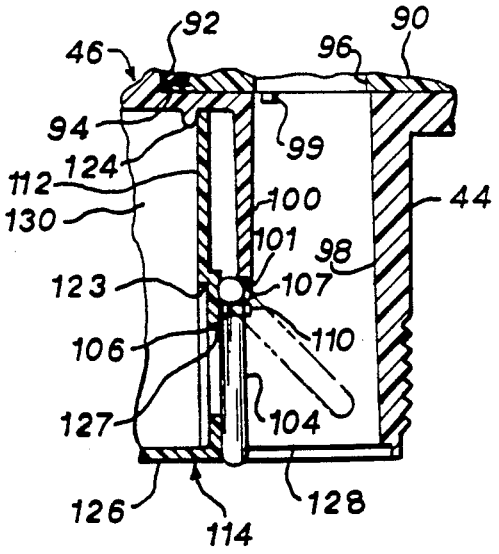
FIG. 6 is a cross-sectional assembled view of the coupling.

As best shown in FIG. 4, in top view the orifice 96 is oblong shaped and the passageway 98 is D-shaped. The upper portion of the flat side of the passageway 98 is defined in part by a wall 100. The wall 100 is molded as an integral part of a housing 102 of the coupling 36 and extends between sides of the outlet portion 44. The lower end 101 of the wall 100 (FIGS. 5, 6 and 8) terminates at or slightly below the top of a door 104, and runs parallel to the top of the door 104 and off-center therefrom toward the side of the door 104 which faces the passageway 98, so that water flowing downwardly through the passageway 98 is diverted from flowing behind the door 104 or from impinging on top of the door 104.

Figure 7:
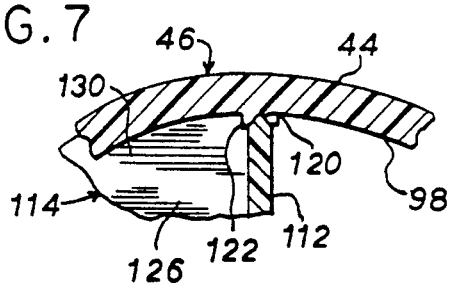
FIG. 7 is a cross-sectional detail view of a portion of the coupling.

The door 104 is hinged to pivot about a generally horizontal axis. The door 104 has cylindrical extensions 106 (FIGS. 5, 6 and 9) at each of its sides which define the horizontal pivot axis and are captured by fingers 107 (FIGS. 5, 6 and 8) formed at the ends of respective ribs 108 (FIGS. 5, 6 and 8) formed in the housing 102 at the corresponding sides of the door 104. The extensions 106 are supported from beneath by ledges 110 (FIGS. 5, 6, 10 and 11) which are integrally formed on wall 112 of insert 114. Wall 112 has V-shaped side edges 120 (FIGS. 7, 10 and 11) which fit into correspondingly shaped ribs 122 (FIGS. 5, 7 and 8) formed on the interior surface of the outlet portion of the housing 102. The top of the wall 112 fits adjacent to rib 124 formed on the top of the outlet portion of the housing 102 between rib 124 and wall 100. Door 104 seats against raised surface 125 of wall 112 to provide a substantially fluid tight seal against water flowing from the passageway 98 through port 127, which is formed in the wall 112 behind the door 104. Behind surface 125, wall 112 is undercut at 123 so as to reduce the thickness of wall 112 in the area of the surface 125.

The insert 114 also has a D-shaped bottom wall 126 which extends orthogonally from the wall 112 and is received in annular shoulder 128 at the bottom of the housing 102. All of the edges of the insert 114 are sealed to the housing 102 to form a fluid tight seal therewith by any suitable method such as adhesive bonding, chemical bonding, friction welding or ultrasonic welding. In one method, the top of the wall 112 and the outer edges of the wall 126 are ultrasonically welded to the housing, with a suitable energizer rib provided at the top of the wall 112 and an energizer rib provided on the bottom facing surface of the shoulder 128, so as to provide material for the ultrasonic welding operation, as is well known in the art. In this method, flashing may be provided at the edges 120 to create a friction weld between the edges 120 and the housing 102, as is also well known in the art. The insert 114 therefore separates passageway 98 from a chamber 130 in the coupling 36. Regardless of what method is used to seal the edges of the insert 114 to the housing 102, it is desirable to create a fluid tight seal between the edges of the insert 114 and the housing 102 so that the entire volume of the chamber 130 is available for collecting leakage entering the chamber 130 through port 127 during a flush. Otherwise, uncontrolled leakage between the edges of the insert 114 and the housing 102 could result in the chamber 130 overflowing into the toilet tank 14, which is to be avoided.

The upper portion of the chamber 130 has an inlet 132 formed in it which opens into the bottom portion of the toilet tank 14. Preferably, the chamber inlet 132 opens into the toilet tank 14 at a level at or slightly below the bottom interior surface of the toilet tank 14 so that any water standing in the toilet tank 14 outside pressure vessel 46 will drain into the chamber 130 through the inlet 132. However, the inlet 132 and port 127 should be open above the spill level of the toilet, which is at the level of the upper surface of the deck 25 of the toilet bowl 12, so that an air break is provided through the inlet 132 and port 127 to the passageway 98 should the bowl 12 be filled up to its spill level and a sub-atmospheric pressure exists in the passageway 98 above the water level therein. This is desirable so as to prevent possibly contaminated water from the toilet bowl 12 from being sucked up into the vessel 46.

It is noted that suction in the passageway 98 would tend to open the door 104, as would an upward flow of water through the passageway 98 when the flow passed the lower edge 134 of the door 104. It is also noted that when the door opens as shown in phantom in FIG. 6, the door extends into the passageway 98, which would restrict upward flow in the passageway 98.

In operation, when the outlet valve 74 of the pressurized flush reservoir vessel 46 is opened, the orifice 96 provides a controlled opening for the contents of the vessel 46 to be expelled through into the passageway 98. The rush of water through the passageway 98 is prevented from entering the chamber 130 by the wall 100 extending slightly past the top of the door 104 on the side of the door confronting the passageway 98 and by the door 104. The space in the coupling 36 directly above the door 104 is substantially sealed from the passageway 98 by the ribs 108, the wall 100 and the top of the door 104. Since the door 104 is hinged at the top, the rush of water through the passageway 98 from the inlet portion 42 to the outlet portion 34 of the coupling 36 tends to drive the door closed to provide a seal of the door against the wall 112.

However, should any water exiting through the passageway 98 leak past the door 104 and through the port 127 which the door covers, such leakage would be collected in the chamber 130. Such leakage may accumulate in the chamber 130 until its volume reaches the height of the inlet 132. Should the accumulation go beyond that height, it would then leak into the toilet tank 14. However, when the flow of water through the passageway 98 subsides, near the end of a flush cycle, the pressure of water accumulated in the chamber 130 opens the door 104 and the accumulated leakage in the chamber 130 and any in the tank 14 drains into the passageway 98 and therefore into the toilet bowl 12, as desired.

The inlet devices 50, 52 and 54 may vent or expel a quantity of water in normal operation, as well as in a failure mode. The water vented or expelled by the inlet devices 50, 52 and 54 is directed outside of the pressurized flush reservoir vessel 46, but inside the toilet tank 14 by the respective vent lines 60, 62 and 64. This water drains to the bottom of the tank 14 and into the chamber 130 through the chamber inlet 132. Once in the chamber 130, this water will also leak through the door 104 into the passageway 98 and into the toilet bowl 12, as desired.

Therefore, the coupling 36 serves to keep the interior of the toilet tank 14 substantially dry such that essentially no pools of standing water remain in the tank.

There may be some negligible volume of water in the bottom of the chamber 130 below the port 127 and on the outside of the outlet portion 34 above the nut 38 and below the inlet 130, but this is very small and not objectionable.

Many modifications and variations of the invention will be apparent to those of ordinary skill in the art but which still embody the spirit of the invention. For example, the coupling 36 could be made integral with the vessel 46 or could be used in a toilet in which the toilet bowl 12 and toilet tank 14 are made in one piece. Therefore, the invention should not be limited to the scope of the preferred embodiments described but should be defined by the claims that follow.

We claim:

1. A coupling for providing communication between a pressurized flush water supply for a toilet and a toilet bowl, comprising:

a housing having an inlet portion for connection to an outlet of said pressurized flush water supply, an outlet portion for connection to an inlet of said toilet bowl and a passageway providing communication between said inlet portion and said outlet portion for providing communication between said outlet of said pressurized flush water supply and said inlet of said toilet bowl;

a chamber in said housing adjacent to said passageway; and an opening in said housing defining an inlet to said chamber for collecting drainage from outside of said chamber and admitting said drainage into said chamber; and a valve in said housing having a port between said chamber and said passageway and means for opening and closing said port for controlling fluid communication between said chamber and said passageway such that liquid drainage accumulated in said chamber can pass through said valve to said passageway and substantial fluid communication from said passageway to said chamber is prevented.

2. The coupling as in claim 1, wherein said chamber inlet opens into a toilet tank for collecting liquid from said toilet tank.

3. The coupling as in claim 1, wherein said inlet portion is above said outlet portion, and said outlet portion is laterally offset from said inlet portion.

4. The coupling as in claim 1, wherein said chamber inlet is located above said valve such that leakage past said valve from said passageway to said chamber will collect in said chamber.

5. The coupling as in claim 1, wherein said chamber inlet and said valve having openings which are at least partially above the spill level of the toilet bowl.

6. The coupling as in claim 1, wherein said valve port is opened in response to a higher pressure on the side of said valve facing said chamber than a pressure on the side of said valve facing said passageway and said port is closed in response to a higher pressure on the side of said valve facing said passageway than a pressure on the side of said valve facing said chamber.

7. The coupling as in claim 6, wherein said chamber inlet is positioned above said port.

8. The coupling as in claim 6, wherein said chamber inlet and said port are positioned to have openings at least partially above a spill level of the toilet bowl.

9. The coupling as in claim 6, wherein said means for opening and closing said port includes a door which opens and closes said port, and said door is hinged to pivot about a substantially horizontal axis located near a top of said door.

10. The coupling as in claim 9, wherein said housing includes a wall in said passageway which extends to approximately the top of said door on a side of said door facing said passageway.

11. The coupling as in claim 1, further comprising means defining an orifice in said passageway to restrict flow from said inlet portion to said outlet portion.

12. The coupling as in claim 11, wherein said orifice is in a plate which is received in said coupling.

13. The coupling as in claim 1, wherein said pressurized flush water supply is received within a toilet tank and supported therein by a cradle.

14. The coupling as in claim 13, wherein said cradle captures heads of fasteners which secure said toilet tank to said toilet bowl.

15. The coupling as in claim 1, wherein said pressurized flush water supply is received within a toilet tank and includes means for diverting water to the interior of said toilet tank.

16. The coupling as in claim 15, wherein said chamber inlet opens into said toilet tank to collect in said chamber water diverted to the interior of said toilet tank.

17. The coupling as in claim 16, wherein said chamber inlet opens into said toilet tank approximately at or below a level of a bottom surface of said toilet tank.

* * * * *